US006604811B2

(12) United States Patent
Sawicki

(10) Patent No.: US 6,604,811 B2
(45) Date of Patent: Aug. 12, 2003

(54) INK JET PRINTER HAVING A FAST ACTING MAINTENANCE ASSEMBLY

(75) Inventor: Paul F. Sawicki, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 117 days.

(21) Appl. No.: 09/738,421

(22) Filed: Dec. 15, 2000

(65) Prior Publication Data

US 2002/0075349 A1 Jun. 20, 2002

(51) Int. Cl.[7] ..... B41J 2/165
(52) U.S. Cl. ..... 347/33
(58) Field of Search ..... 347/33, 28, 32, 347/87, 93, 100, 101, 105, 95, 45

(56) References Cited

U.S. PATENT DOCUMENTS 5,168,291 A * 12/1992 Hiramatsu et al. ..... 347/19
5,657,065 A * 8/1997 Lin ..... 347/93
5,706,038 A * 1/1998 Jackson et al. ..... 347/33
5,786,830 A * 7/1998 Su et al. ..... 347/33
6,332,481 B1 * 12/2001 Shinada et al. ..... 141/18
6,337,354 B1 * 1/2002 Katsumata et al. ..... 347/31

FOREIGN PATENT DOCUMENTS

JP 401159286 A * 6/1989 ..... 347/105
JP 406143597 A * 5/1994 ..... 347/31
JP 406234221 A * 8/1994 ..... 347/33

* cited by examiner

*Primary Examiner*—Shih-wen Hsieh
(74) *Attorney, Agent, or Firm*—Tallam I. Nguti

(57) ABSTRACT

A fast acting printhead maintenance assembly is provided and includes a support frame and a flexible wiping member mounted to the support frame. The flexible wiping member has a body portion, and a wiping edge adjoining the body portion for making wiping contact with a nozzle face of a printhead during relative motion between the printhead and the flexible wiping member. The fast acting printhead maintenance assembly also includes a liquid ink wicking and absorbing member attached to the body portion of the flexible wiping member for immediately and quickly wicking and absorbing liquid ink wiped by the wiping edge from the nozzle face of the printhead, thereby resulting in continued high quality printed images and a relatively longer printhead life.

11 Claims, 2 Drawing Sheets

INK JET PRINTER HAVING A FAST ACTING MAINTENANCE ASSEMBLY

RELATED APPLICATION

This application is related to U.S. application Ser. No. 09/738,729 (Applicant's Docket No. D/A0963Q) entitled "INK JET PRINTER HAVING A CLEANING BLADE CLEANER ASSEMBLY" filed on the same date herewith, and having at least one common inventor.

BACKGROUND OF THE INVENTION

The present invention relates generally to printers such as ink jet printers, and more particularly to such a printer having a fast acting printhead maintenance assembly that quickly and immediately wipes, wicks and blots residual liquid ink from an ink jet printhead.

An ink jet printer of the type frequently referred to as drop-on-demand, has at least one printhead from which droplets of ink are directed towards a recording medium. Within the printhead, the ink is contained in a plurality of channels. Piezoelectric devices or power pulses cause the droplets of ink to be expelled as required, from orifices or nozzles located at the end of the channels. In thermal ink jet printing, the power pulses are usually produced by resistors also known as heaters, each located in a respective one of the channels. The heaters are individually addressable to heat and vaporize the ink in the channels. As a voltage is applied across a selected heater, a vapor bubble grows in that particular channel and ink bulges from the channel nozzle. At that stage, the bubble begins to collapse. The ink within the channel retracts and then separates from the bulging ink thereby forming a droplet moving in a direction away from the channel nozzle and towards the recording medium whereupon hitting the recording medium a spot is formed. The channel is then refilled by capillary action which, in turn, draws ink from a supply container of liquid ink.

The ink jet printhead may be incorporated into either a carriage type printer or a page width type printer. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time on a stationary recording medium, such as a sheet of paper or a transparency.

After each such swath is printed, the sheet of paper is transported or advanced forwardly (usually the movement involves stepping or indexing) a distance that is equal to the height of the printed swath or of a portion thereof so that the next printed swath is properly registered in an overlapping or contiguous manner therewith.

As is well known, in order to provide printhead long life, and to ensure continued high quality printing, ink jet printers usually include some type of a printhead maintenance assembly intended to clean the nozzles and prevent liquid ink from drying up and clogging such nozzles. Conventionally, such maintenance assemblies include a wiping only device and a capping device. Unfortunately, depending on the unpredictable amount of ink left as a meniscus or bubble at each nozzle and requiring cleaning, a wiping only device often merely disturbs such a meniscus, usually removes only some of that amount of ink. The result is ineffective cleaning of such nozzles, and hence poor quality prints for a while, and a reduced life for the entire printhead.

There is therefore a need for a fast acting printhead maintenance assembly that quickly and immediately scrapes, wipes, wicks and blots residual liquid ink from ink jet printheads in order to assure continued high quality printed images and a relatively longer printhead life.

SUMMARY OF THE INVENTION

In accordance with the present invention, there has been provided a fast acting printhead maintenance assembly that includes a support frame and a flexible wiping member mounted to the support frame. The flexible wiping member has a body portion, and a wiping edge adjoining the body portion for making wiping contact with a nozzle face of a printhead during relative motion between the printhead and the flexible wiping member. The fast acting printhead maintenance assembly also includes a liquid ink wicking and absorbing member attached to the body portion of the flexible wiping member for immediately and quickly wicking and absorbing liquid ink wiped by the wiping edge from the nozzle face of the printhead, thereby resulting in continued high quality printed images and a relatively longer printhead life.

BRIEF DESCRIPTION OF THE DRAWINGS

In the detailed description of the invention presented below, reference is made to the drawings, in which.

DETAILED DESCRIPTION OF THE INVENTION

Figure 1:
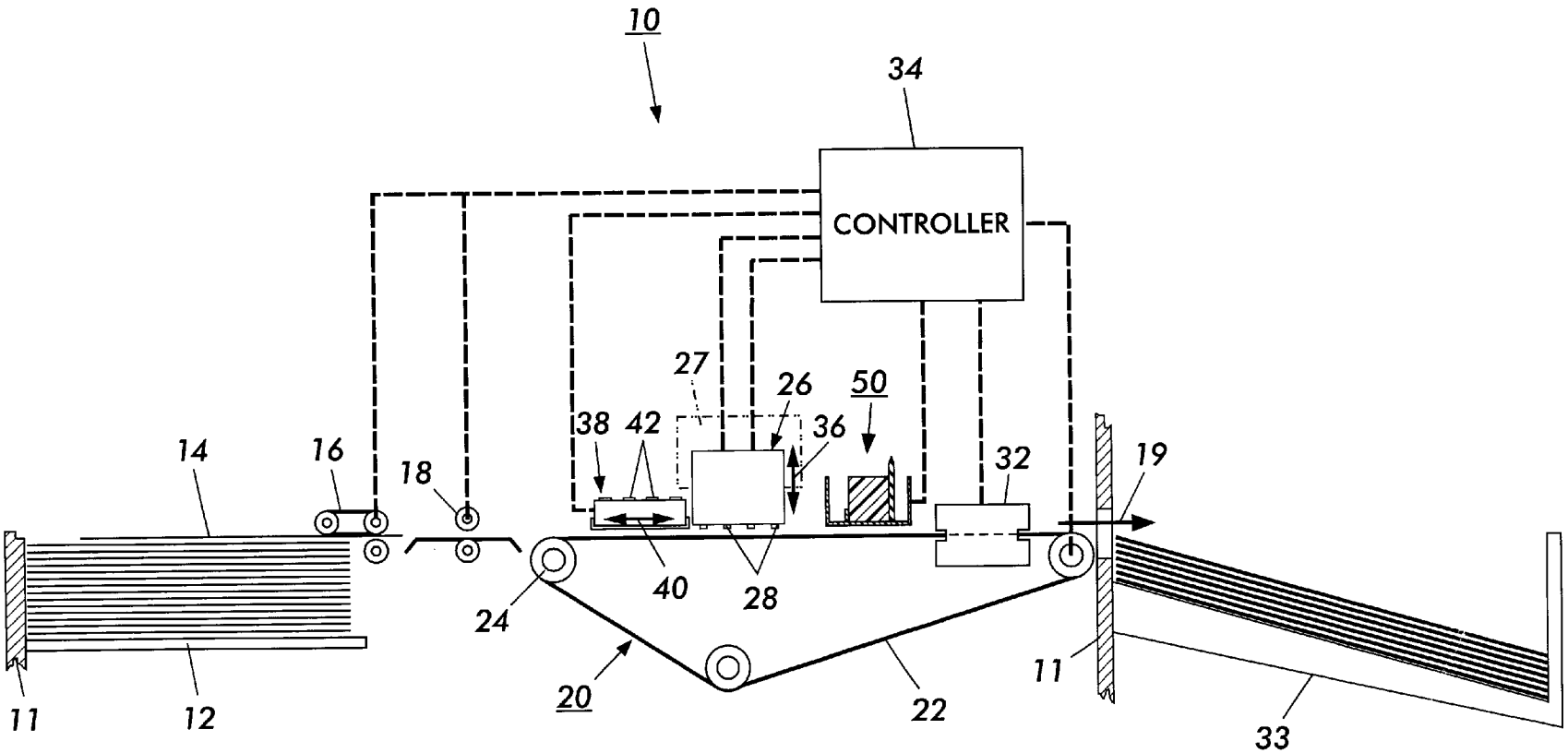
FIG. 1 is a schematic illustration of a liquid ink printer including the fast acting printhead maintenance assembly in accordance with the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Although the present invention discussed herein may be used for drying any image which is created by a liquid ink printer, the description of the present invention will be described in the environment of an ink jet printer such as that shown in the drawings.

Referring now to FIG. 1, it illustrates a schematic elevational view of a liquid ink printer 10, for instance, an ink jet printer, of the present invention. The liquid ink printer 10 includes a frame 11 (shown partially) and an input tray 12 containing sheets of a recording medium 14 to be printed upon by the printer 10. Single sheets of the recording medium 14 are removed from the input tray 12 by a pickup device 16 and fed by feed rollers 18 to a transport mechanism 20. The transport mechanism 20 moves the sheet in the direction of the arrow 19, and by means of a feed belt or belts 22 driven by rollers 24 beneath a liquid ink printhead assembly 26 including at least a printhead 28 for printing ink images on the sheet or recording medium 14.

The printhead assembly 26 may include one or more partial width array ink jet printheads 28, or one or more pagewidth printheads 28, that are each connected to a liquid ink supply 27, and supported in a printing position by a printhead support (not shown) in a confronting relation with the belt 22. During printing, the printheads 28 deposit liquid ink on the recording medium 14 as it is carried by the belt 22 beneath and passed such printheads 28. Each of the printheads 28 includes an array of print nozzles, for instance, staggered or linear arrays, having a length sufficient to deposit ink in a print zone across the width of the recording medium 14. The recording medium 14 is then carried by the belt 22 through a dryer assembly 32, from which it is unloaded into an output tray 33.

A controller 34 controls the operation of the transport mechanism 20, which includes the pickup device 16, the feed roller 18 and the drive roller 24. In addition, the controller 34 controls the movement of the printhead assembly 26, printing by the printheads 28, and maintenance of the printheads 28 in part using the fast acting printhead maintenance assembly 50 in accordance with the present invention (to be described in detail below). The controller 34 can also include a plurality of individual controllers, such as microprocessors or other known devices dedicated to perform a particular function.

At the completion of a printing operation or when otherwise necessary, such as during a power failure, the printhead assembly 26, which is movable in the directions of an arrow 36, is moved away from the belt 22 for maintenance by the fast acting printhead maintenance assembly 50 of the present invention, and for capping by a capping device 38. The capping assembly 38 as shown is movable in the directions of the arrow 40 beneath the printhead assembly 26 for capping thereof. Once the cap assembly 38 is positioned directly beneath the printhead assembly 26, the printhead assembly 26 is moved towards the belt 22 and into contact with a plurality of capping gaskets 42 located on the capping assembly 38.

Figure 2:
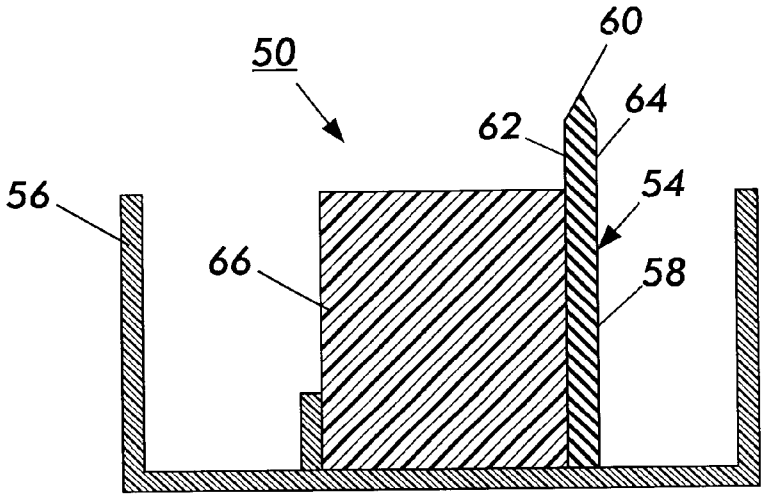
FIG. 2 is an enlarged illustration of a first embodiment of a combination wiper/blotter of the fast acting printhead maintenance assembly of the present invention.
Figure 3:
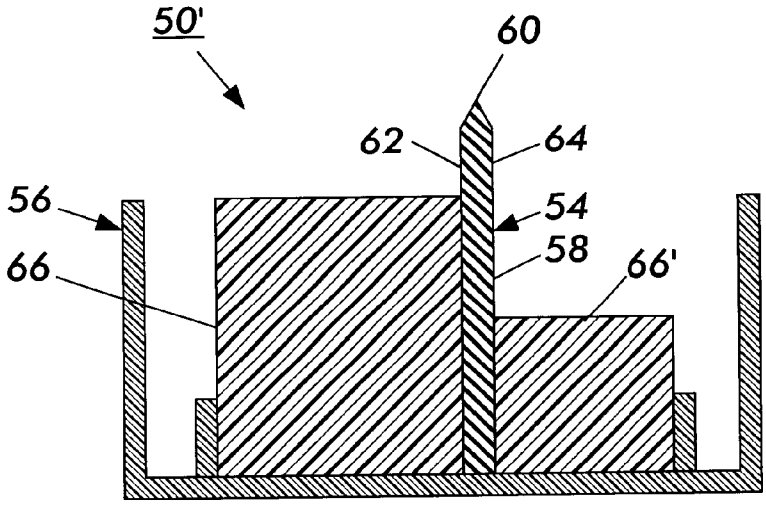
FIG. 3 is an enlarged illustration of a second embodiment of a combination wiper/blotter of the fast acting printhead maintenance assembly of the present invention.

Referring now to FIGS. 1–3, the fast acting printhead maintenance assembly 50 may be moveable in the direction of the arrow 52 in order to create relative motion between the printheads 28 and the assembly 50. Alternatively, the printhead assembly 26, and hence the printheads 28, may be moveable in order to create such relative motion. In either case, the fast acting printhead maintenance assembly 50 includes a flexible wiping member or blade 54 that is mounted to a support frame 56. The support frame 56 may be a catch pan or trough as shown, and the flexible wiping member or blade 54 is mounted thereto in a cantilevered member with an extending distal end thereto as shown. The flexible wiping member or blade 54 has a body portion 58, and a wiping edge 60 at the distal end for making wiping contact with the nozzle face of the printhead 28 during relative motion between such printhead and the flexible wiping member or blade 54. The flexible wiping member or blade 54 has a first surface 62 and a second and opposite surface 64 as shown, and as shown, the wiping edge 60 may include a gentle taper or chamfer 65 on both the first side 62 and the second and opposite side or surface 64 for facilitating easy movement thereof across the nozzle face of the printhead.

Referring now to FIGS. 1–3, first and second embodiments of the fast acting printhead maintenance assembly are illustrated as 50, 50' and each also include a liquid wicking and absorbing member 66, 66' that is attached to at least one of the first and the second surfaces 62, 64 of the body portion 58 as shown in FIGS. 2 and 3. In FIG. 2, a first embodiment 50 is shown in which the liquid wicking and absorbing member 66 is attached only to the first surface 62, whereas in FIG. 3 a second embodiment 50' has liquid ink wicking and absorbing members 66, 66' attached to both surfaces 62, 64, as shown, for wicking and absorbing liquid ink with relative motion in either direction. As attached to the body portion 58 of the flexible wiping member or blade 54, the liquid wicking and absorbing member 66 is suitable for immediately and quickly wicking and absorbing liquid ink wiped by the wiping edge 60 from the nozzle face of the printhead 28, thereby resulting in continued high quality printed images, and in a relatively longer printhead life.

In accordance with the present invention, the liquid wicking and absorbing member 66 preferably is made from a POREX material (POREX is a tradename of Porex Industries in Georgia USA). The POREX material is a porous plastic material.

As gathered from disclosures by Porex Industries, porous plastic materials have membranes and intricate network of open-celled, omni-directional pores running through them. These pores, which can be made in average pore sizes down to one micron give porous plastic materials their unique combination of filtering and wicking capabilities, as well as structural strength.

Unlike direct passages in woven synthetic materials and metal screens, the pores in porous plastic materials join to form many tortuous paths. Porous plastic materials act both as surface filters by trapping particles larger than their average pore size, and also as depth filters by trapping much smaller particulate matter deep in their complex channels. When used as a wicking device the open-celled pore structure of these materials creates effective capillary channels for liquid transfer.

Porous plastic materials as such are used as marker tips, often is called nibs, in a variety of writing instruments to wick ink from a reservoir to the writing surface. As such they function in capillary systems using inks having viscosity and surface tensions similar to that of water. Examples of such porous plastic materials are polyvinylidene fluoride (PVDF) or polyethylene (PE), depending on strength, ink flow, durability and shape considerations.

For increased absorbency, an additive (a surfactant) may be added to the PP or PE raw material in the process of making the resultant POREX porous plastic material suitable or liquid wicking and absorbing member 66 of the present invention.

As can be seen, there has been provided a fast acting printhead maintenance assembly that includes a support frame and a flexible wiping member or blade mounted to the support frame. The flexible wiping member has a body portion, and a wiping edge adjoining the body portion for making wiping contact with a nozzle face of a printhead during relative motion between the printhead and the flexible wiping member. The fast acting printhead maintenance assembly also includes a liquid ink wicking and absorbing member attached to the body portion of the flexible wiping member for immediately and quickly wicking and absorbing liquid ink wiped by the wiping edge from the nozzle face of the printhead, thereby resulting in continued high quality printed images and a relatively longer printhead life.

While the present invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A fast acting printhead maintenance assembly comprising:

(a) a support frame;

(b) a flexible wiping member mounted to said support frame, said flexible wiping member having a body portion, and a wiping edge adjoining said body portion for making wiping contact with a nozzle face of a printhead during relative motion between the printhead and said flexible wiping member, said wiping edge including a gentle taper for facilitating easy movement thereof across the nozzle face of the printhead; and (c) a liquid ink wicking and absorbing member attached to said body portion of said flexible wiping member for immediately and quickly wicking and absorbing liquid ink wiped by said wiping edge from the nozzle face of the printhead, said liquid ink absorbing member comprising a porous plastic material including a surfactant additive for increasing absorbency of said porous plastic material, thereby resulting in continued high quality printed images and a relatively longer printhead life.

2. The fast acting printhead maintenance assembly of claim 1, wherein said liquid ink wicking and absorbing material comprises a porous plastic material.

3. The fast acting printhead maintenance assembly of claim 2, wherein said porous plastic material is made from polyethylene.

4. The fast acting printhead maintenance assembly of claim 2, wherein said porous plastic material is made from polypropylene.

5. The fast acting printhead maintenance assembly of claim 2, wherein said porous plastic material is made from polyvinylidene.

6. The fast acting printhead maintenance assembly of claim 1, wherein said liquid ink wicking and absorbing member is mounted to one of a first, and a second and opposite, surfaces of said body portion.

7. The fast acting printhead maintenance assembly of claim 1, wherein said liquid ink absorbing member is mounted to both of a first, and a second and opposite, surfaces of said body portion.

8. An ink jet printer for producing high quality images comprising:

(a) a support frame in part defining a sheet travel path;

(b) a sheet supply and handling assembly mounted to said frame for supplying and moving a sheet through said sheet travel path;

(c) a printhead having a nozzle face, said printhead being connected to an ink supply and located along said sheet travel path for printing ink images on the sheet moving through said sheet travel path; and (d) a fast acting printhead maintenance assembly comprising (i) a flexible wiping member mounted to said support frame, said flexible wiping member having a body portion, and a wiping edge adjoining said body portion, for making wiping contact with said nozzle face of said printhead during relative motion between said printhead and said flexible wiping member, said wiping edge including a gentle taper for facilitating easy movement thereof across the nozzle face of the printhead; and (ii) a liquid ink wicking and absorbing member attached to said body portion of said flexible wiping member for immediately and quickly wicking and absorbing liquid ink wiped by said wiping edge from the nozzle face of the printhead, said liquid ink absorbing member comprising a porous plastic material including a surfactant additive for increasing absorbency of said porous plastic material, thereby resulting in continued high quality printed images and a relatively longer printhead life.

9. The ink jet printer of claim 8, wherein said liquid ink wicking and absorbing material comprises a porous plastic material.

10. The ink jet printer of claim 8, wherein said liquid ink wicking and absorbing member is mounted to one of a first, and a second and opposite, surfaces of said body portion.

11. The ink jet printer of claim 8, wherein said liquid ink absorbing member is mounted to both of a first, and a second and opposite, surfaces of said body portion.

* * * * *